US006536992B1

(12) United States Patent
Floe

(10) Patent No.: US 6,536,992 B1
(45) Date of Patent: Mar. 25, 2003

(54) DOCK STRUCTURE WITH ADJUSTABLE FIXTURES

(76) Inventor: Wayne G. Floe, 48473 State Hwy. 65, McGregor, MN (US) 55760-9514

( * ) Notice: Subject to any disclaimer, the term of this patent is extended or adjusted under 35 U.S.C. 154(b) by 0 days.

(21) Appl. No.: 09/874,537

(22) Filed: Jun. 5, 2001

(51) Int. Cl.[7] ..... B63B 21/04; E02B 3/20
(52) U.S. Cl. ..... 405/218; 114/258
(58) Field of Search ..... 405/1–7, 218, 405/220; 114/256, 258, 259, 263

(56) References Cited

U.S. PATENT DOCUMENTS 3,688,728 A * 9/1972 Lederer, Jr. ..... 114/219
4,087,977 A * 5/1978 Kuhlman ..... 405/218
4,352,597 A * 10/1982 Kay ..... 114/263
4,683,833 A * 8/1987 Meriwether ..... 114/267
4,900,192 A * 2/1990 Wood ..... 405/211
5,056,452 A * 10/1991 McCain ..... 114/263
5,421,612 A * 6/1995 Floe ..... 280/491.5
5,538,308 A * 7/1996 Floe ..... 296/61
5,775,771 A * 7/1998 Floe ..... 280/149.2
6,068,282 A * 5/2000 Floe ..... 280/491.2

* cited by examiner

*Primary Examiner*—Thomas B. Will
*Assistant Examiner*—Tara L. Mayo
(74) *Attorney, Agent, or Firm*—Charles A. Johnson

(57) ABSTRACT

An improved modular dock structure with adjustable fixtures. Structural members are shown having one or more retention channels for cooperating with captive mounting structures various fixtures. Fixtures are adjustably mounted to the structural members using one or more mounting structures, each having a captive nut and collar retained in an associated retention channel. Fixtures described include a coupling hinge structure to couple modular sections together; floatation devices; clete structures; railings; watercraft bumpers; support legs; support legs with augers affixed; and support legs with wheels rotatably attached.

32 Claims, 11 Drawing Sheets

DOCK STRUCTURE WITH ADJUSTABLE FIXTURES

BACKGROUND OF THE INVENTION

1. Field of the Invention

This invention relates generally to dock structures; and more particularly, to an improved dock structure having adjustable fixtures.

2. State of the Prior Art

Dock structures have been known for many years. Generally, docks are known to exist to extend from a landmass or other fixed starting point, and extend over an area that is impassable or difficult to cross by normal foot traffic. Such areas can be over water, swampy terrain, or the like. With the general purpose of supporting a user, prior art docks were characteristically constructed with a predetermined width and length, affixed to the stable or passable landmass, or structure, and set upon supports extending to a support surface under the unstable area or water to be traversed. Docks have historically been constructed of wood. Wood structures are of course susceptible to rot and damage when exposed to the elements, and thereby become unsafe for human use.

In climates where the water or unstable terrain are subjected to freezing and thawing, the elements are known to damage or destroy dock supporting structures. This led prior art dock structures to be made removable to avoid the affects of the freezing and thawing conditions. It is known to put dock structures on wheels that can progress along the bottom or supporting surface under the water or unstable terrain. The wheeled configurations are adapted to allow the entire dock structure to be pulled back up onto the stable landmass when freezing is anticipated. These large structures are often heavy, ungainly and difficult to maneuver during the installation and extraction process.

The prior art has recognized the concern of rotting and deterioration of wood dock structures and have been improved through construction using materials that are not subjected to the rotting or deterioration process. Prior art docks have been fabricated of various types of metals, such as steel, which are heavy and subject to rusting and deterioration, though at a slower rate of decay then the wooden structures. Aluminum has been found to be a preferable construction material in that it is lightweight, has sufficient strength when properly designed, can be economically fabricated in desired shapes and is not subjected to the corrosive deterioration that other metals display.

Prior art aluminum structures for docks have been developed. Such prior art structures are normally fabricated in the size and configuration of the desired dock structure, and as a result, also tend to be large and unwieldy. Such aluminum structures are often fitted with wheeled assembly to allow the dock to be rolled into the unstable material or water to thereby support the dock structure at a predetermined level. Such prior art aluminum dock structures are characteristically constructed of members that are either welded, riveted, or bolted together. This type of structure is extremely unwieldy when the shape of the dock is desired to have dock sections extending laterally to the basic dock extension from the landmass. Such structures are also difficult to ship from point of manufacture to point of use. These types of prior art dock structures have the disadvantages of unwieldy sizes and shapes for installation and removal, and difficulty of assembly when multiple dock segments are utilized.

It is a primary object of this invention to provide an improved dock structure.

Another primary object of the invention is to provide an improved modular dock structure utilizing uniformly fabricated structural members.

Yet another object of this invention is to provide an improved dock structure having adjustable fixture positioning.

Another object of the invention is to provide an improved dock structure having a unique coupling mechanism for adjustably connecting various fixtures and dock sections.

A further object of the invention is to provide an improved structural member that is useful in constructing modular sections, where the structural member includes one or more retention channels to cooperate mounting structures to mount coupling hinge members and other fixtures.

A further object of the invention is to provide an improved coupling hinge structure to cooperate with associated dock sections.

Still a further object of the invention is to provide an improved dock structure having a plurality of dock sections interconnectable in selectable configurations utilizing an improved interconnection mechanism.

A further object of the invention is to provide an improved dock structure having a portion of a novel interconnection system integrally formed in the peripheral members of selected dock sections, and arranged to cooperate with an improved intercoupling fixture.

Another object of the invention is to provide an improved dock structure wherein one or more dock sections may be adapted to float.

Still a further object of the invention is to provide an improved dock structure having one or more dock sections supportable on the bottom support surface under the water or unstable area to be traversed.

Yet another object of the invention is to provide a modular dock structure wherein two or more dock sections allow varying dock configurations.

A further object of the invention is to provide a modular dock structure that is easy to ship to the location of intended use.

Still a further object of the invention is to provide a modular dock structure that is fabricated from extruded aluminum members for efficiency of manufacture structural strength, minimum weight and structural durability.

These and other more detailed and specific objectives will become clear from a consideration of the Drawings in conjunction with the Summary of Invention, together with the Detailed Description of the Preferred Embodiments.

SUMMARY OF THE INVENTION

The present invention includes a modular design particularly well-suited for variable configuration dock structures. One aspects of the invention is a novel structural member that has a face structure, a rear surface opposite the face structure, a lower member, and one or more longitudinal retention channels in the face surface. One embodiment utilizes a pair of parallel retention channels in the face surface to provide structural strength for the coupling action. The retention channels are adapted to cooperate with and slidably retain one or more mating mounting structures to affix various fixtures to an associated structural member. The various fixtures include mounting brackets that are adapted for use with a predetermined number of mounting structures to mount the associated fixture to a structural member. An additional retention channel in the lower member can be utilized to mount the structural member to a float device.

A structural member can be extruded from non-corrosive metal, such as aluminum, and can be cut to predetermined lengths to form modular sections to provide an efficient and cost-effective manufacturing system for various sizes of modular sections.

Modular sections having a pair of side members and a pair of end members interposed therebetween and constructed of one or more of the foregoing structural members can be selectively interconnected in any desired modular configuration by utilizing one or more coupling hinge structures mounted to the retention channels on the sections to be joined together, with all of the coupling hinge structures on the two associated sections joined together by one or more pin structures.

Various fixtures can be affixed to the sections having one or more of the novel structural members. The fixtures include mounting brackets having holes therethrough in cooperative alignment with associated ones of the retention channels. Mounting structures include bolts through associated holes and a nuts and collars retained in a mating relationship in associated ones of the retention channels, whereby a fixture including its mounting bracket can be moved to a desired position along an associated structural member and can be clamped in place by tightening the bolt and nut assemblies to pull the retained collars into contact with the retention channel ridges.

In addition to the coupling hinge structures used to join modular sections, various other fixtures capable of being mounted to the versatile joining and mounting structure of the structural member can include an adjustable leg structure with varying attachments, a clete structure, an adjustable support wheel structure, a vertically adjustable bumper structure, and railing structures.

The mounting portion of the various fixtures can be formed to a large extent from integrally formed extruded aluminum and cut to length required for cooperation with the associated structural member, thereby providing an efficient and cost-saving manufacturing system where various sizes of modular sections.

From the foregoing summary of the invention, it is apparent that the various stated purposes and objectives have been satisfied.

DESCRIPTION OF THE PREFERRED EMBODIMENTS

Figure 1:
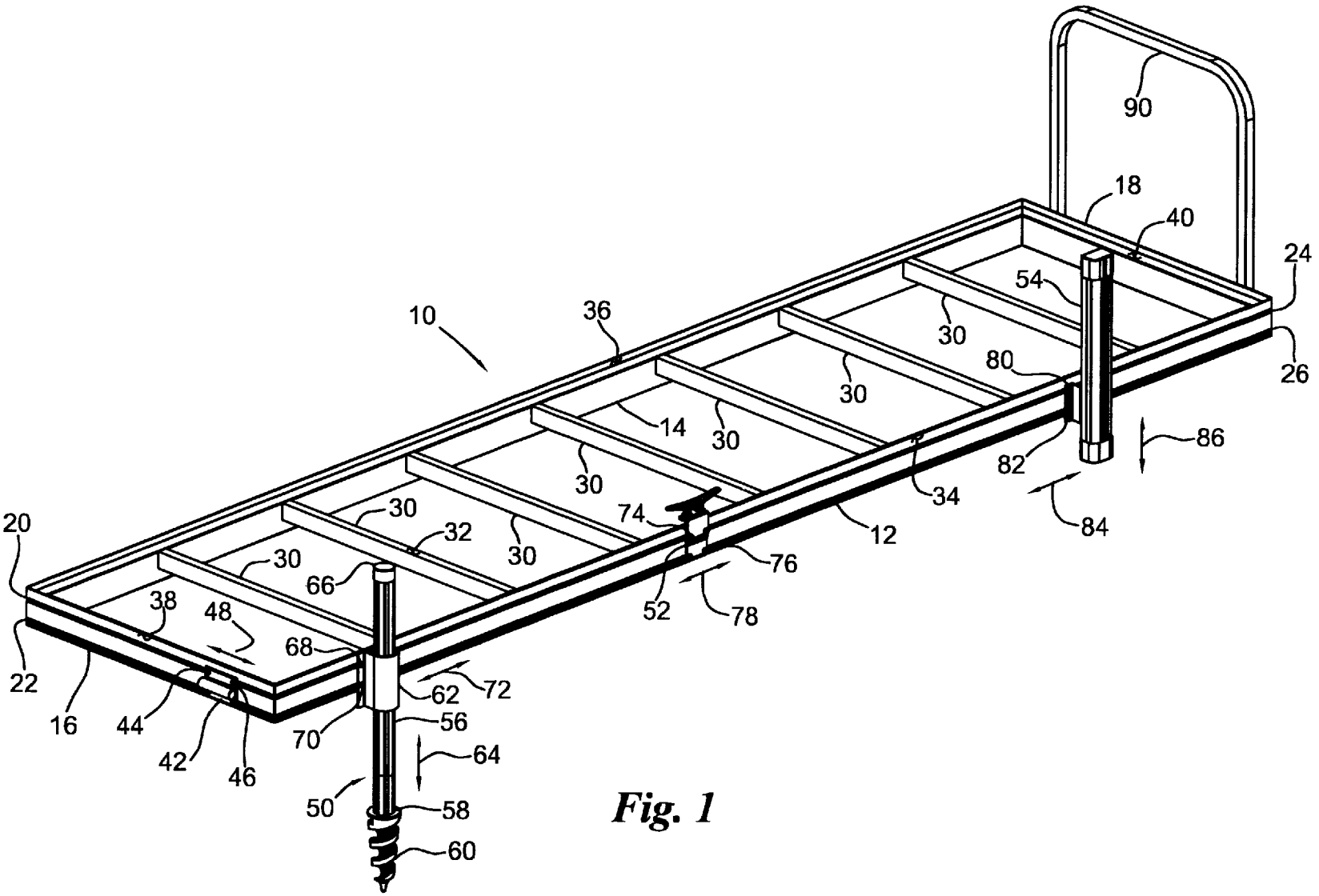
FIG. 1 is a perspective view of a dock section structure illustrating various aspects of the invention.

In the following description, to the extent possible for clear description, elements that appear in different figures will bear the same reference numerals.

FIG. 1 is a perspective view of a dock section structure illustrating various aspects of the invention.

A dock section 10 is comprised of a pair of side members 12 and 14 and a pair of spaced-apart end members 16 and 18. End member 16 has a pair of longitudinally extending retention channels 20 and 22, and side member 12 is illustrated with a pair of longitudinal retention channels 24 and 26. While two retention channels are shown in each of the members 12 and 16, it should be understood that a single retention channel can be utilized, though two are the preferred embodiment for strength and ease of operation. It should be understood also that more than two retention channels can be utilized to provide additional strength.

A plurality of spaced-apart deck support members 30 are arranged between and affixed at their respective ends to side members 12 and 14. Each of the plurality of spaced-apart deck support members 30 has a deck support surface 32. Side members 12 and 14 have deck support surfaces 34 and 36 respectively, and spaced-apart end members 16 and 18 have deck support surfaces 38 and 40 respectively.

As will be described in more detail below, the retention channels 20, 22, 24, and 26 are adapted to cooperate with mounting structures on various fixtures that are slidably engaged and retained within the respectively associated retention channel.

A number of fixtures can be associated with the various retention channels. These fixtures include a portion of a coupling hinge structure 42 mounted by mounting structures 44 and 46 having captive mounting portions within retention channel 20. Similar mounting structures (not shown) cooperate with retention channel 22. Mounting structures 44 and 46 are subject to being loosened to allow the coupling hinge portion 42 to be moved to any desired position in the directions of arrow 48 along the length of end member 16. It is of course understood that multiple coupling hinge structures 42 can be associated with end member 16, as will be described and illustrated below.

Other fixtures such as support leg 50, clete 52, and bumper 54 are associated with retention channels 24 and 26 in side member 12.

Supporting structure 50 has a support leg 56 having a lower end 58 coupled to an auger 60. A mounting bracket 62, as will be described in more detail below, allows the leg structure 56 to be adjusted upwardly and downwardly in the direction of arrow 64. Leg 56 can be rotated at its upper end 66 to cause the auger to drill into a supporting surface or to be removed from the supporting surface. Mounting structures 68 and 70 on either side of bracket 62 cooperate with retention structures 24 and 26 respectively, and allow the support structure 50 to be moved to a desired position in the directions of arrow 72. The support structure will be described in more detail below. It is of course understood that the support leg 56 need not use the auger 60, and instead, can support the structure on end 58.

The clete fixture has a pair of upper mounting elements 74 and a pair of lower mounting elements 76 in cooperation with retention channels 24 and 26, respectively. When the mounting elements 74 and 76 are loosened, the clete fixture 52 can be adjusted longitudinally along the length of side member 12 in the directions of arrow 78, The bumper structure 54 has a pair of upper mounting structures 80 and a pair of lower mounting structures 82 in cooperation with retention channels 24 and 26, respectively. The mounting structures allow the bumper structure 54 to be adjusted along the length of side member 12 in the directions of arrow 84. The structure of the bumper 54, as will be described in more detail below, allows the bumper to be vertically adjusted upwardly or downwardly in the directions of arrow 86. A railing structure 90 is illustrated affixed to the outside surface of end member 18 by bracket structures (not shown).

In the preferred embodiment, the retention channels 20, 22, 24, and 26 would also exist in the surfaces (not shown) of side member 14 and end member 18 so that the fabrication process can utilize identical cross section structures. While this is preferred, it should be understood that side member or end member structures can be utilized without the described retention channels if such structure is desired for other manufacturing or functional purposes.

The improved dock structure 10 contemplates one or more deck sections (not shown) to be supported and mounted to deck support surfaces 32, 34, 36, 38 and 40.

Figures 2, 3:
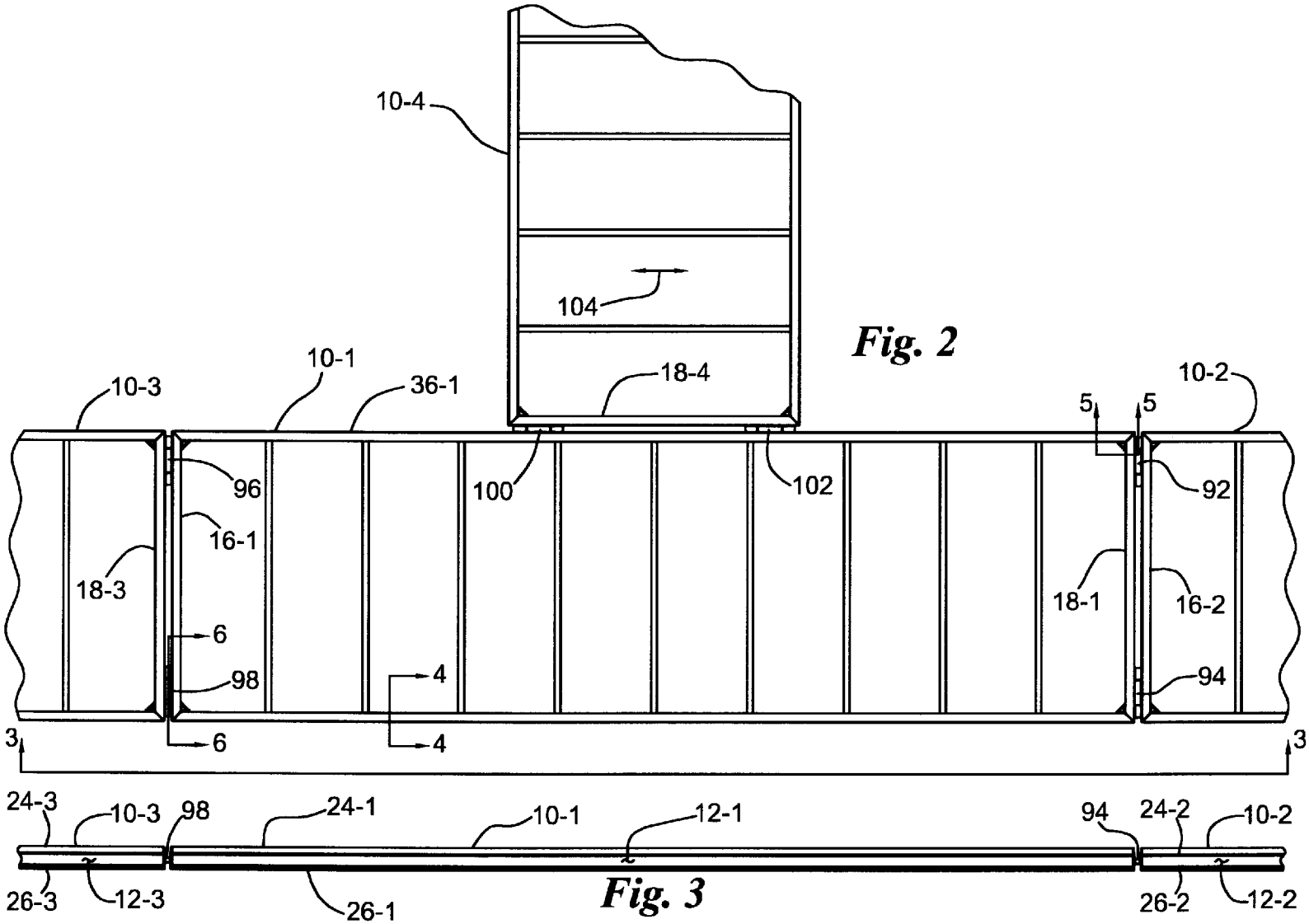
FIG. 2 is a plan view of a dock structure and illustrates configuration flexibility of the invention.
FIG. 3 is a face view taken at 3—3 in FIG. 2.

FIG. 2 is a plan view of a dock structure and illustrates configuration flexibility of the invention.

Dock section 10-1 is illustrated coupled to dock section 10-2 with end member 18-1 coupled to end member 16-2 by coupling hinge structures 92 and 94. Dock section 10-1 is coupled to dock section 10-3 wherein end member 16-1 is coupled to end member 18-3 by a pair of coupling hinge structures 96 and 98. While two coupling hinge structures are illustrated at each dock section juncture, it is clear that one may suffice depending on the spacing of the cooperating member; and more than two can be used.

Dock section 10-1 is coupled to dock section 10-4, which extends substantially perpendicular thereto. Side member 36-1 is coupled to end member 18-4 of dock section 10-4 by coupling hinge structures 100 and 102.

This configuration is provided to illustrate that the overall length of a particular dock structure can be selectively made as long as desired by coupling together additional lengths of dock sections. Further, the modular design is such that various configurations can be accommodated as desired by connecting dock sections laterally as desired. Further, as described in FIG. 1, adjustments for positioning can be made along the various retention channels, and it is understood dock section 10-4 can be adjusted along the length of side member 36-1 to any desired positions as shown by arrow 104.

FIG. 3 is a face view taken at 3—3 in FIG. 2. This view illustrates the coupling hinge structures 94 and 98 between dock section 10-1 and dock section 10-2, and dock section 10-1 and dock section 10-3, respectively. The retention channels 24-1 and 26-1 in side member 12-1 are illustrated as substantially parallel and running substantially the entire length of side member 12-1. It is understood that the spacing of the retention channels may be modified to accommodate the needs of the structure, and that the retention channels 24-1 and 26-1 need not necessarily extend the entire length of side member 12-1. Similarly retention channels 24-2 and 26-2 are illustrated in side member 12-2, and retention channels 24-3 and 26-3 are illustrated in side member 12-3.

Figure 4:
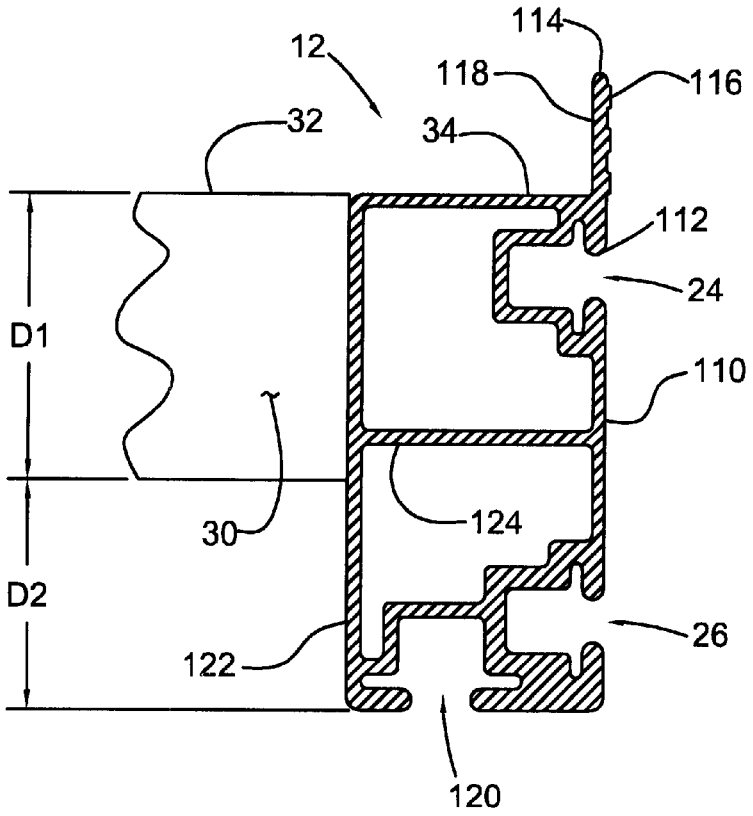
FIG. 4 is a cross-sectional view of a dock side member taken at 4—4 in FIG. 2.

FIG. 4 is a cross-sectional view of a dock side member taken at 4—4 in FIG. 2. Side member 12 has retention channels 24 and 26 formed in a shape to mate with and retain associated mounting portions of mounting structures on an associated fixture (not shown). The front member 110 has a face surface extending from the bottom of side member 12 to just above the upper lip 112 of retention channel 24, is essentially smooth. An upper projection 114 has a face surface 116 having a number of parallel ridges running longitudinally of the length of side member 12 to strengthen projection 114. A rear surface 118 is arranged in cooperation with deck support surface 34 to protect the edges of a deck member (not shown) that is to be supported on deck support surfaces 32 and 34. It is of course understood that upper projection 114 need not be utilized in all embodiments, but that it does provide stability and protection for the one or more deck members that may be utilized on a dock section.

An additional longitudinal retention channel 120 is located at the underside of side member 12. It also has a mating shape to cooperate with an associated mounting portion of a mounting structure (not shown) that may be affixed to the underside of side member 12. A rear member 122 joins the deck support surface member and lower end of the side member. A strengthening web 124 joins the rear member 122 to the front member 110 between the retention channels 24 and 26, thereby in combination forming a double box beam structure. One end of one of the plurality of spaced-apart deck support members 30 is affixed to rear member 122. In a preferred embodiment the depth D1 of deck support member 30 is in the order of about 2.5 inches and the distance D2 from the bottom of deck support 30 to the bottom of side member 12 is in the order of about 2.0 inches. It is of course understood that these dimensions are illustrative only and that the overall size and dimensions of side member 12 and it's pertinent structures will be selected to accommodate the loads and operational conditions in which the improved dock structure will be utilized.

In the preferred embodiment, side member 12 is fabricated from extruded aluminum thereby being substantially noncorrosive in fresh water conditions. The preferred fabrication process lends itself to establishing an appropriate mating structure for retention channels 24, 26, and 120. It is understood that various other methods of forming the retention channels will be obvious to those skilled in the art, without departing from the scope of the invention. It will likewise be apparent to those skilled in the art that the configuration of the rear member 122 and cross member 124 may be modified to include additional cross members for purposes of strengthening the structure, or removal of the cross member 124 for lighter structural usage and strength.

Figure 5:
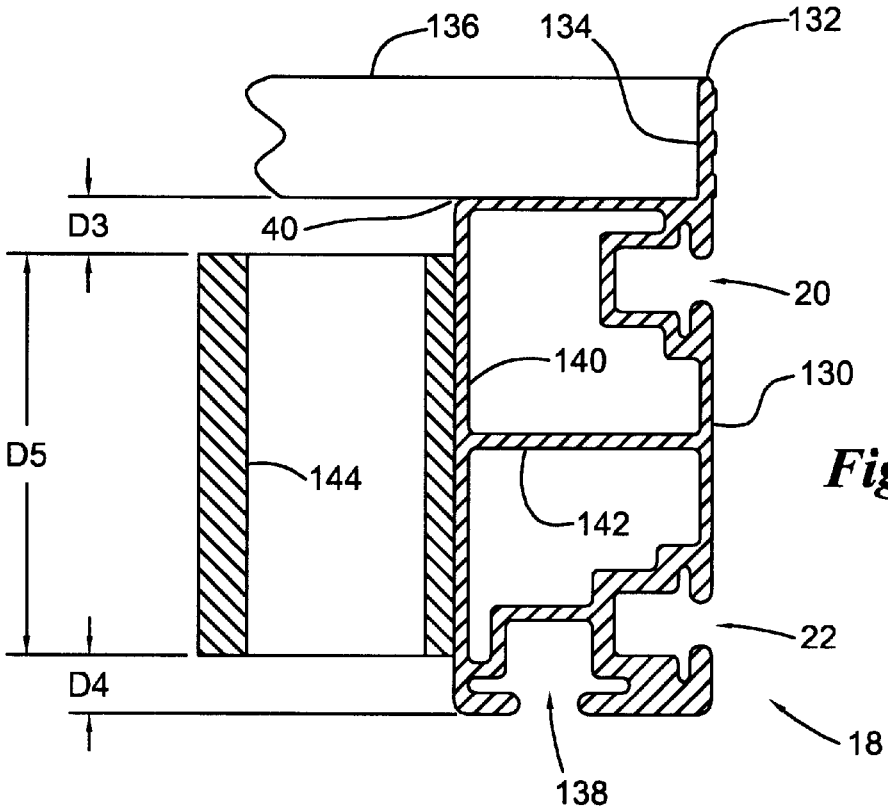
FIG. 5 is a cross-sectional view of a dock end member taken at 5—5 in FIG. 2.

FIG. 5 is a cross-sectional view of a dock end member taken at 5—5 in FIG. 2. End member 18 has a pair of longitudinal retention channels 20 and 22 parallelly disposed and spaced apart on its front surface 130. The retention channel 20 and 22 have a mating shape to retain and slidably engage associated mounting portions of mounting structures used with associated fixtures. In a similar manner to that of FIG. 4. End member 18 has an upper projection 132 whose rear surface 134 engages and protects the edge of deck member 136. The deck member 136 is supported on deck support surface 40 of end member 18. End member 18 has an additional longitudinal retention channel 138 longitudinally extending along its bottom portion. Back member 140 joins the support surface 40 and lower portion of end member 18, and has a central web 142 joining the rear member 140 to the front member 130. A gusset 144 is attached to a portion of rear member 140 and provides additional strength and rigidity for the load imparted to the end members.

Though gusset 144 could be the same height as end member 18, in the preferred embodiment gusset 144 is positioned beneath the lower surface of deck member 136 a distance D3, which for the preferred embodiment is in the order of about 0.5 inch. The gusset 144 does not extend to the bottom of end member 18, and is recessed a distance D4 in the order of about 0.5 inch. Gusset 144 has a height D5 in the order of about 3.5 inches. Again, as mentioned above, these dimensions have found to be advantageous for the configuration of end member 18 illustrated, but various differing dimensions and changes will be apparent those skilled in the art in the event different structural strengths are required for any particular application. Such changes of dimension or arrangement will not depart from the scope of the invention.

End member 18, as illustrated, is fabricated utilizing an extrusion process of aluminum material, as described with respect to the side member illustrated in FIG. 4.

It can be seen that the structural portions of the extruded aluminum portion of side member 12 and end member 18 are essentially identical in cross-section. The manufacturing process allows lengths of material to be fabricated and various lengths cut from the base stock can be fabricated as end members or side members. Such a configuration allows the extruded material to be cut to the various lengths desired and to be welded or otherwise affixed into the shapes shown in FIG. 1.

Figure 6:
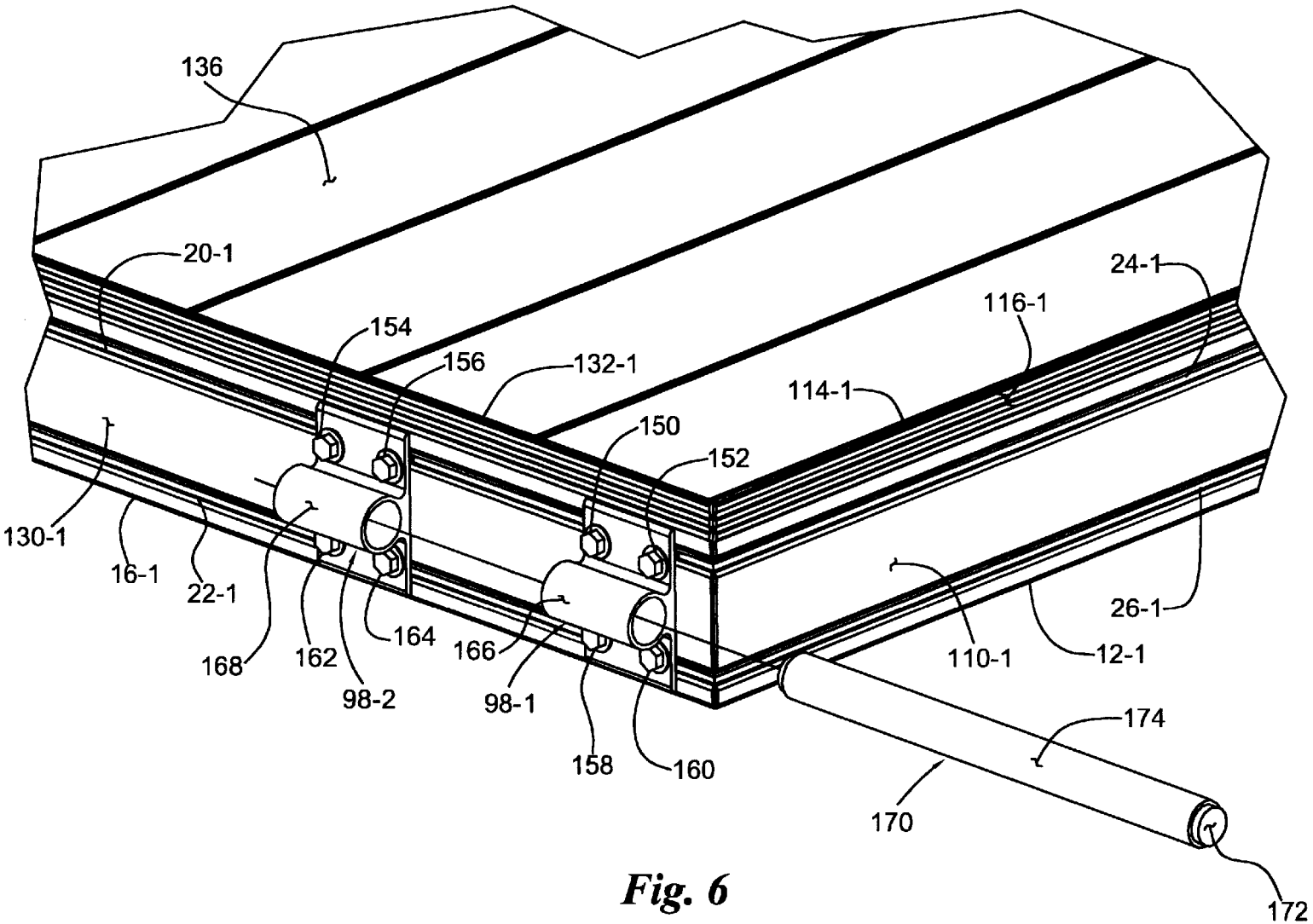
FIG. 6 is a perspective view of a portion of a dock structure taken at 6—6 in FIG. 2.

FIG. 6 is a perspective view of a portion of a dock structure taken at 6—6 in FIG. 2.

For illustration purposes, end member 16-1 has a pair of halves 98-1 and 98-2 of the coupling hinge structure 98. Coupling hinge structure 98-1 is slidably mounted to retention channel 20-1 by mounting structures 150 and 152 cooperating with retention channel 20-1. In a similar manner coupling hinge structure 98-2 is slidably retained in retention channel 20-1 by mounting structures 154 and 156. Coupling hinge structure 98-1 is slidably engaged with retention channel 22-1 by mounting structures 158 and 160. Similarly, coupling hinge element 98-2 is slidably retained to retention channel 22-1 by mounting structures 162 and 164. Coupling hinge structure 98-1 has a cylindrical portion 166 aligned with a cylindrical portion 168 on coupling hinge structure 98-2. These structures are arranged to cooperate with mating structures (not shown) on an adjacent end or side member. An elongated pin 170 is made up of a cylindrical metal rod 172 that is coated with a synthetic coating 174 over its outer surface. The pin structure 170 is of a cross sectional dimension to slidably mate with cylinder portions 166 and 168, together with the mating portions of the mounting structures (not shown) on an associated dock member. Metal pin 172 is characteristically made of steel or other material having sufficient strength to hold dock section together, and the coupling structures 98-1 and 98-2 are characteristically made from aluminum. It is understood, of course, that these coupling structures could also be made of material other than aluminum.

The synthetic coating 174 on the connecting pin 170 serves several purposes. In the first instance, it protects the metallic rod 172 from exposure to water, thereby inhibiting any corrosion that might occur. Further, it provides a barrier between the surface of rod 172 and the inner surface of cylindrical members 166 and 168, thereby eliminating or minimizing any corrosive action that might occur from contact of dissimilar metals. Finally, it provides a resilient contact that tends to hold the rod 172 in place, and minimizes any noise or knocking action that would be present in a metal-to-metal contact. While rod 170 tends to stay in place without any restraint, it should be understood that the ends of rod 172 could be threaded to receive restraining nuts (not shown), could be drilled to receive a cotter pin (not shown) or any other suitable method of holding pin 170 in place.

Figure 7:
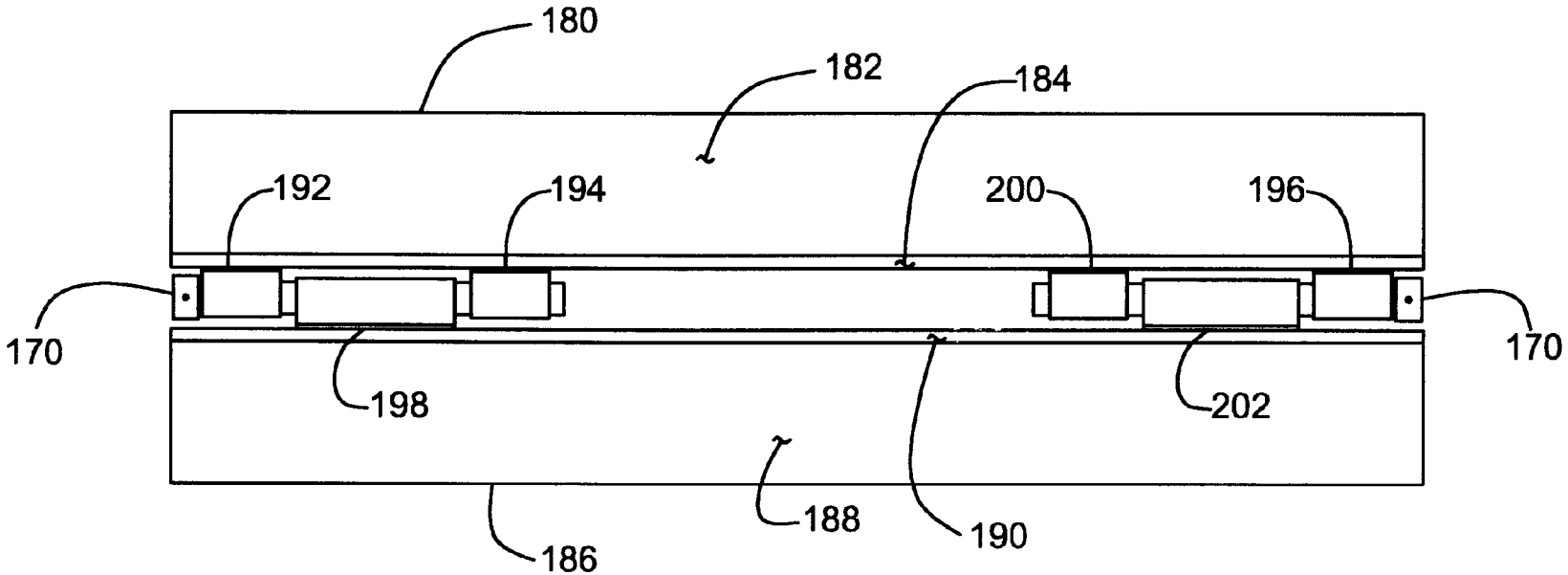
FIG. 7 is a top view of coupling hinge structures.

FIG. 7 is a top view of coupling hinge structures. It illustrates a structural member 180 having a deck support surface 182 and upward projection 184 formed perpendicular thereto. Member 180 is adapted to cooperate with a second structural member 186 having a deck support surface 188 and upward projection 190. Structural member 180 has coupling hinge structures 192, 194, and 196 mounted thereto. Structural member 186 has coupling hinge structures 198, 200, and 202 mounted thereto. It will be noted that all of the coupling structures 192, 194, 196, 198, 200, and 202 may be adjusted to any desired positions along the lengths of structural members 180 and 186, respectively, as described above. Pin 170, when inserted in the cylindrical structure, as described with reference to FIG. 6, of each of the coupling structures causes structural members 180 and 186 to be coupled together.

Figure 8:
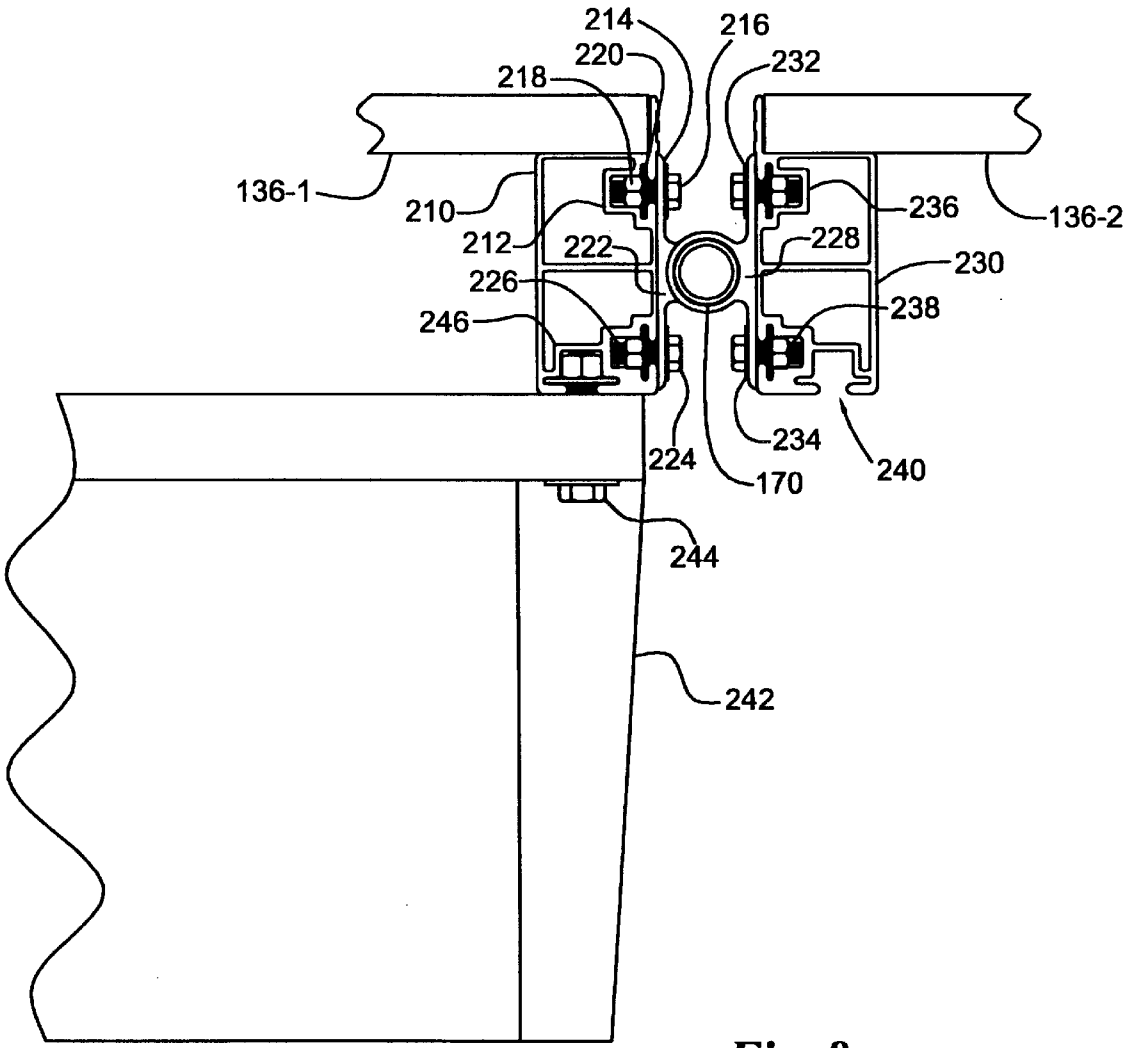
FIG. 8 is a side view of an adjustable coupling hinge structure for joining dock structures and coupling to a floatation device.

FIG. 8 is a side view of an adjustable coupling hinge structure for joining dock structures and coupling to a floatation device. Member 210 supports deck member 136-1 at its upper surface. Retention channel 212 cooperates with mounting structure 214. Mounting structure 214 includes a bolt 216 that cooperates with captive nut 218 to hold captive collar 220 within the mating shape of retention channel 212. As bolt head 216 is tightened, nut 218 is drawn into compressing force with collar 220 such that coupling hinge structure 222 is mounted firmly to the face of dock member 210. In a similar manner mounting structure 224 cooperates with retention channel 226. Coupling hinge member 228 is coupled to coupling hinge member 222 by pin 170. Coupling hinge member 228 is coupled to dock structural member 230 by mounting structures 232 and 234 that cooperate with retention channels 236 and 238 respectively. In this illustration, lower retention channel 240 is not utilized.

A floatation structure 242 is mounted by mounting structure 244 to lower retention channel 246. Floatation structure 242 can be selected from any floatation devices that are known, including, but not limited to various forms of air tight chambers, closed synthetic cellular structures, or the like.

Figure 9:
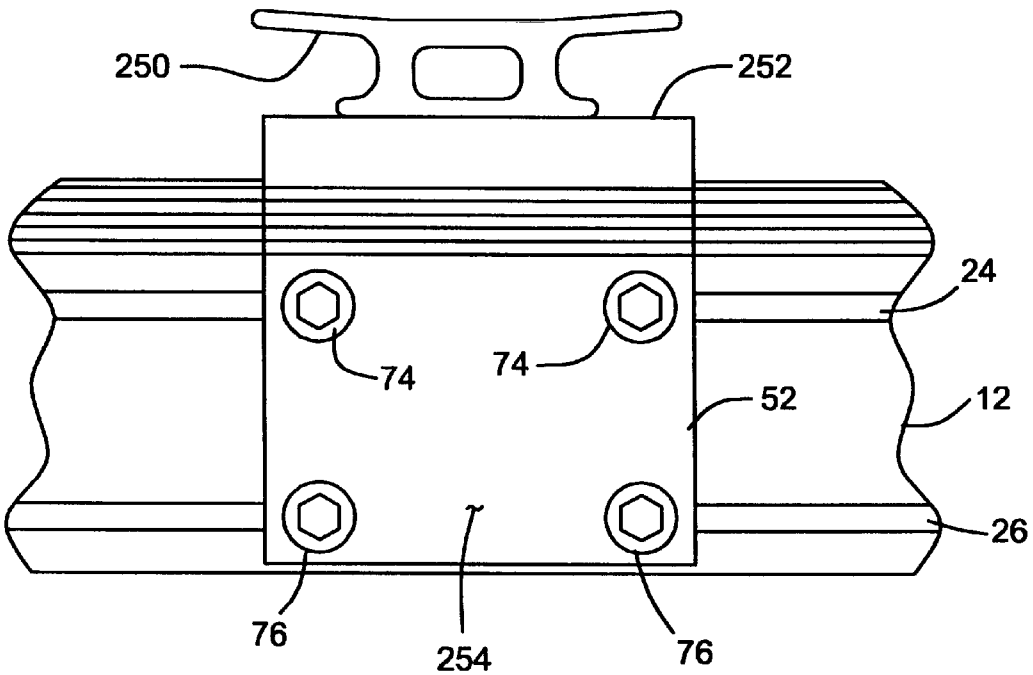
FIG. 9 is a face view of a clete structure adjustably mounted to a dock member.

FIG. 9 is a face view of a clete structure adjustably mounted to a dock member. It is understood that the clete fixture 52 can be utilized with any dock member, but reference will be made to the configuration illustrated in FIG. 1. In this arrangement, a clete fixture 52 has a clete structure 250 mounted at its top 252. The clete fixture 52 has mounting structure 74 in cooperation with retention channel 24, and mounting structures 76 in cooperation with retention channel 26. The clete fixture 52 is capable of being positioned along the length of dock member 12 and is utilized for tying up watercraft or the like to the dock. The body portion 254 of clete fixture 52 is characteristically constructed of extruded aluminum and cut to length as necessary or desired. The clete element 250 can be constructed of aluminum or other metal materials.

Figure 10:
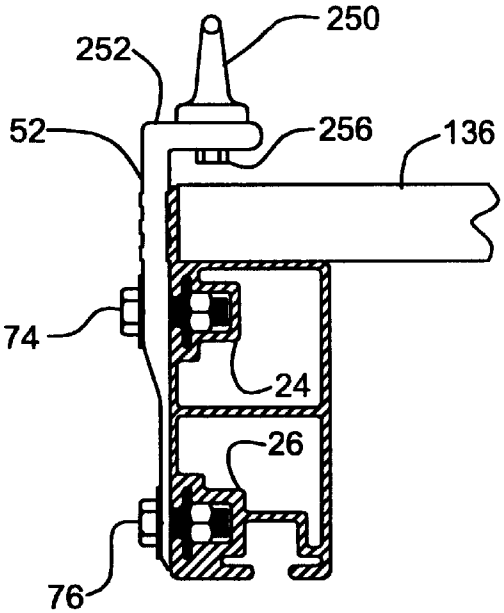
FIG. 10 is an end and partially cutaway view of the clete structure shown in FIG. 9.

FIG. 10 is an end and partially cutaway view of the clete structure shown in FIG. 9. Clete 250 is retained to the upper surface 252 of clete fixture 52 by one or more bolts 256. The mounting structures 74 cooperates with retention channel 24 and the mounting structures 76 cooperates with the retention channel 26 in a manner similar to that described above.

Figure 11:
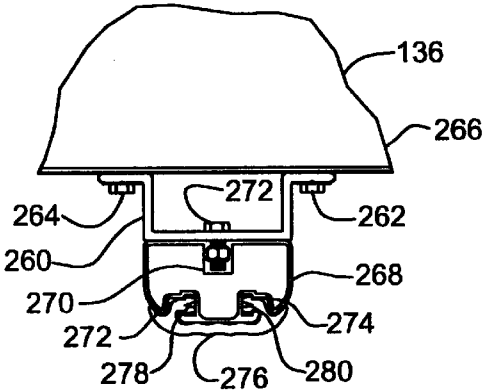
FIG. 11 is a top view of a dock bumper structure.

FIG. 11 is a top view of a dock bumper structure. A mounting bracket 260 is affixed by mounting structures 262 and 264 to dock member 266. Bumper support structure 268 includes a longitudinal retention channel 270 that cooperates with mounting structure 272 to affix the bumper support structure 268 to bracket 260. Mounting structure 272 in cooperation with retention channel 270 allows the bumper structure 268 to be raised and lowered vertically to selected heights relative to the surface of deck 136. This height adjustment is also appropriate relative to the height of the bumper structure relative to the surface of the water or other terrain over which the dock passes.

Bumper support structure 268 also includes a pair of longitudinal channels 272 and 274. A bumper element 276 includes projections 278 and 280 to cooperate with retention channels 272 and 274, respectively. Bumper element 276 can be made of synthetic material that is deformable and functions to make non-marring contact with watercraft or the like that come in contact with the bumper structure. The bumper element 276 is held in place by the interaction projections 278 and 280 in associated retention channels 272 and 274. The bumper element 276 can be readily replaced if damaged or worn to an extent to be unsightly or unworkable.

The bracket 260 and the bumper support structure 268 are characteristically formed from extruded aluminum, it being understood that other materials may also be used. The bumper element 276 can be formed by extrusion or molding, and retention elements 278 and 280 brought into retaining compliance with retention channels 272 and 274, respectively.

Figure 12:
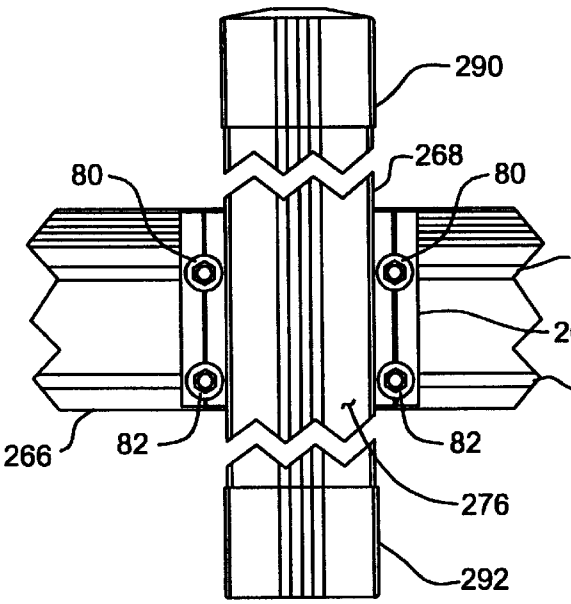
FIG. 12 is a face view of the dock bumper structure shown in FIG. 11.

FIG. 12 is a face view of the dock bumper structure shown in FIG. 11. As previously described with respect to FIG. 11, the bumper fixture includes the bracket 260 being slidably mounted to retention channel 24 by upper mounting structures 80, and to retention channel 26 by mounting structures 82. A cap 290 slidably engages the upper end of the bumper support structure 268 and its associated bumper member 276. Similarly, a lower cap 292 slides over the lower end of the bumper assembly.

Figure 13:
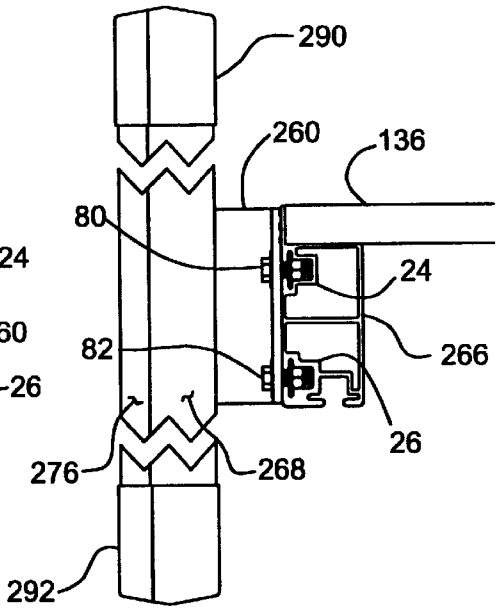
FIG. 13 is a side view of the dock bumper structure of FIG. 12.

FIG. 13 is a side view of the dock bumper structure of FIG. 12. This view illustrates the slidable coupling of bracket 260 to the bumper support structure 268 and to the dock structural member 266. Mounting structure 80 is in slidable cooperative relationship with retention channel 24 and mounting structure 82 is in slidable cooperation with retention channel 26, in a manner similar to described above.

Figure 14:
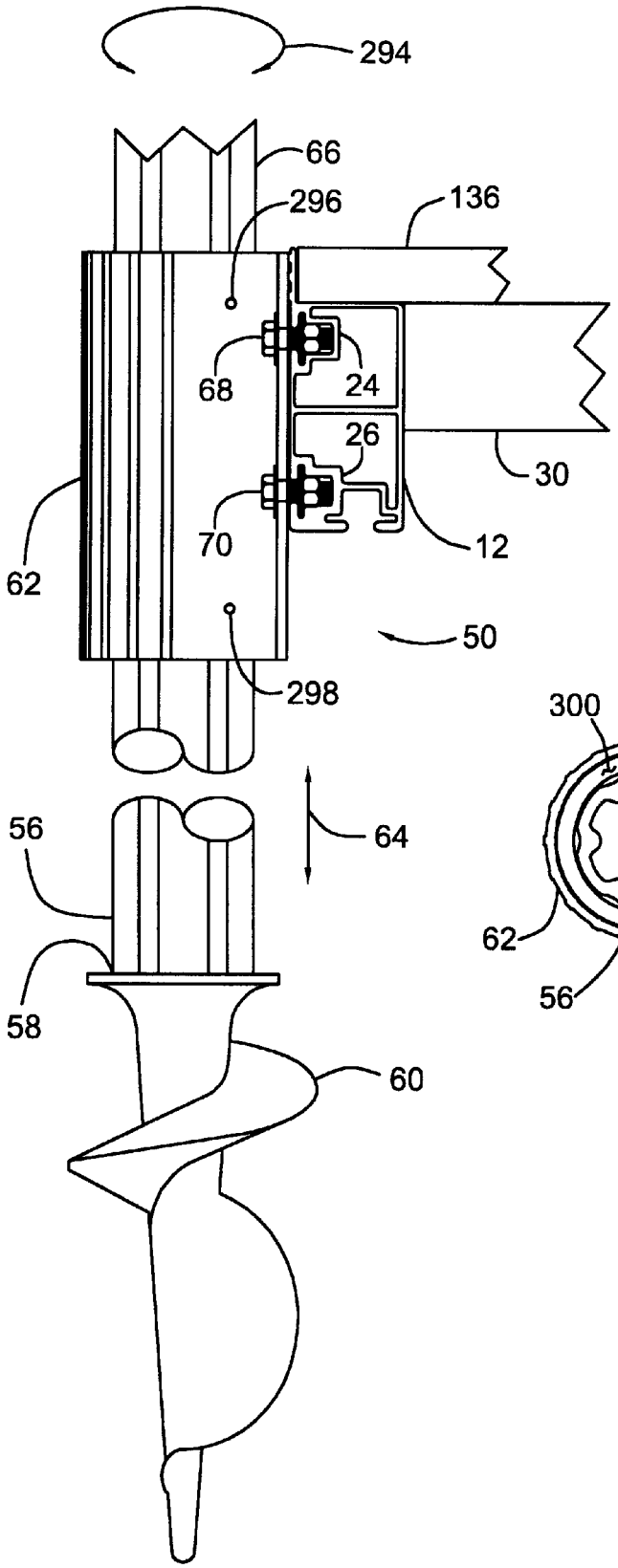
FIG. 14 is a side view of an adjustable support post mounted to a dock frame member.
Figure 15:
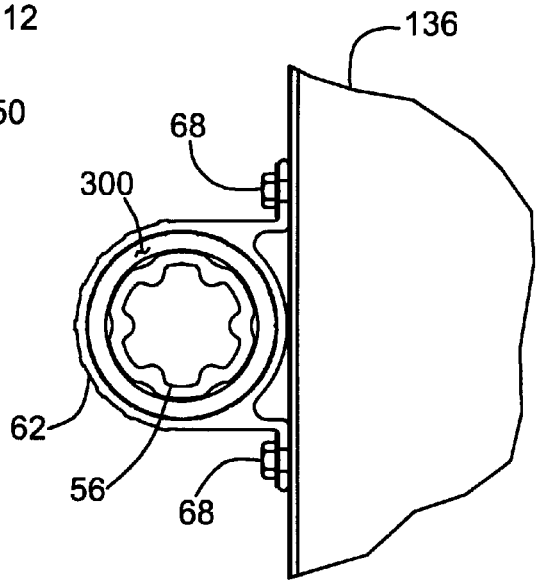
FIG. 15 is a top view of the adjustable support post of FIG. 14.

FIG. 14 is a side view of an adjustable support post mounted to a dock frame member. The fixture structure 50 includes a vertical leg 56 having its lower end 58 affixed to an auger 60. The leg is movable upwardly and downwardly, as indicated by arrow 64 within bracket 62. Leg 56 has a cross-sectional shape, as is illustrated in FIG. 15, that can be gripped at its upper end 66 by a wrench (not shown) allowing leg 56 to be rotated in either direction as illustrated by arrow 294. When positioning, then, rotation of end 66 in a first direction will cause auger 60 to drill into the supporting surface and will hold the associated dock section fixed in place. To remove the dock section, leg 56 is rotated in a second opposite direction causing auger 60 to back out of contact with the underlying surface. When the leg structure 56 is at a desired location, set screws 296 and 298 can be set to hold pressure on leg 56. It is of course understood that other mechanisms for securing leg 56 with relation to bracket 62 can be used.

As described with regard to FIG. 1, mounting structure 68 cooperates with retention channel 24 and mounting structure 70 cooperates with retention channel 26 in member 12. As previously described, member 12 is affixed to cross member 30 and cooperates with cross member 30 to support deck 136.

FIG. 15 is a top view of the adjustable support post of FIG. 14. In this view, it can be seen that there is a cylindrical member 300 disposed between the outer surface of leg 56 and the inner surface of housing 62. The cylindrical member 300 acts as a sleeve and protects the inner surface of mounting bracket 62 from undue wear when leg 56 is subjected rotation.

Figure 16:
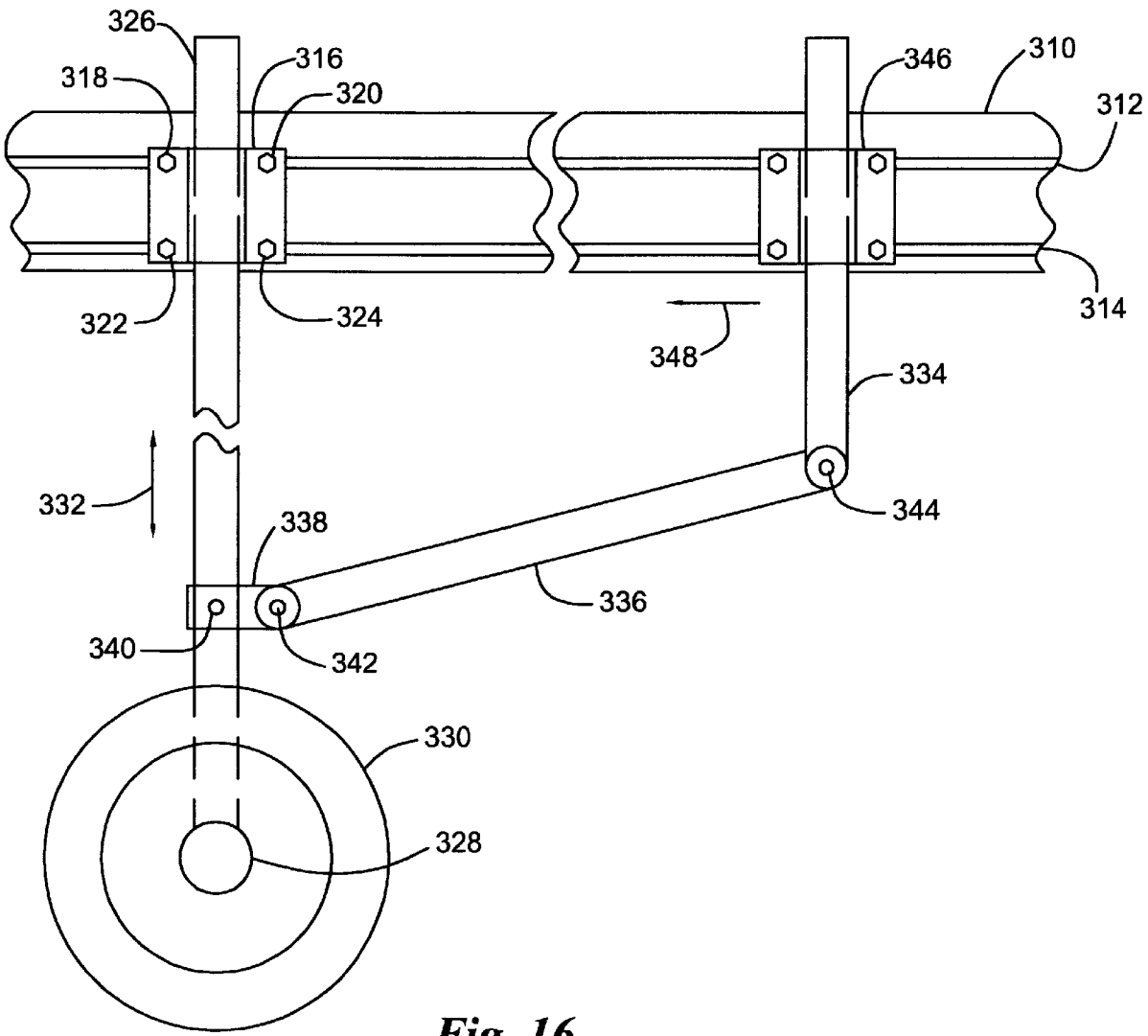
FIG. 16 illustrates an adjustable wheel structure for use with a dock section.

FIG. 16 illustrates an adjustable wheel structure for use with a dock section. A structural member 310 has a pair of retention channels 312 and 314 having retention configurations similar to those described above. A first mounting bracket 316 is mounted to member 310 by upper mounting structure 318 and mounting structure 320 in cooperation with retention channel 312. Lower mounting structure 322 and 324 are in mounting cooperation with retention channel 314. A support leg 326 extends through mounting bracket 316 to be rotatably mounted at its lower end 328 to a wheel 330. In some configurations the leg 326 provides enough strength to allow the structure to be rolled on wheel 330 without additional bracing. In operation, leg 326 is raised or lowered in the direction of arrows 332 to adjust member 310 to the desired height.

For those structures that require additional bracing to give sufficient strength to leg 326, a brace arrangement comprised of leg 334 connecting arm 336 and bracket 338 can be used. Bracket 338 is affixed to leg 326 as by a bolt 340 or other suitable interconnection mechanism. Bracket 338 is rotatably coupled at rotation point 342 to one end of the connecting arm 336. The bottom end of leg 334 is rotatably connected at rotation point 344 to the opposite end of the connecting arm 336. A bracket 346 is coupled to retention channels 312 and 314 in a manner similar to that described relative to bracket 316.

It can be seen, then, that as leg 326 is moved downwardly, it is necessary to adjust bracket 346 in the direction of arrow 348 to allow the bracing structure to keep leg 326 essentially vertical. Additional adjustment can be accomplished through raising or lowering leg 334 within bracket 346 as leg 326 that supports wheel 330 is raised or lowered. Once positioned, the mounting structures that clamp bracket 346 to member 310 can be tightened.

For leg structures that are sufficiently long or where the bottom is rough or mucky, it may be necessary to add an additional brace structure of the type just described.

Figure 17:
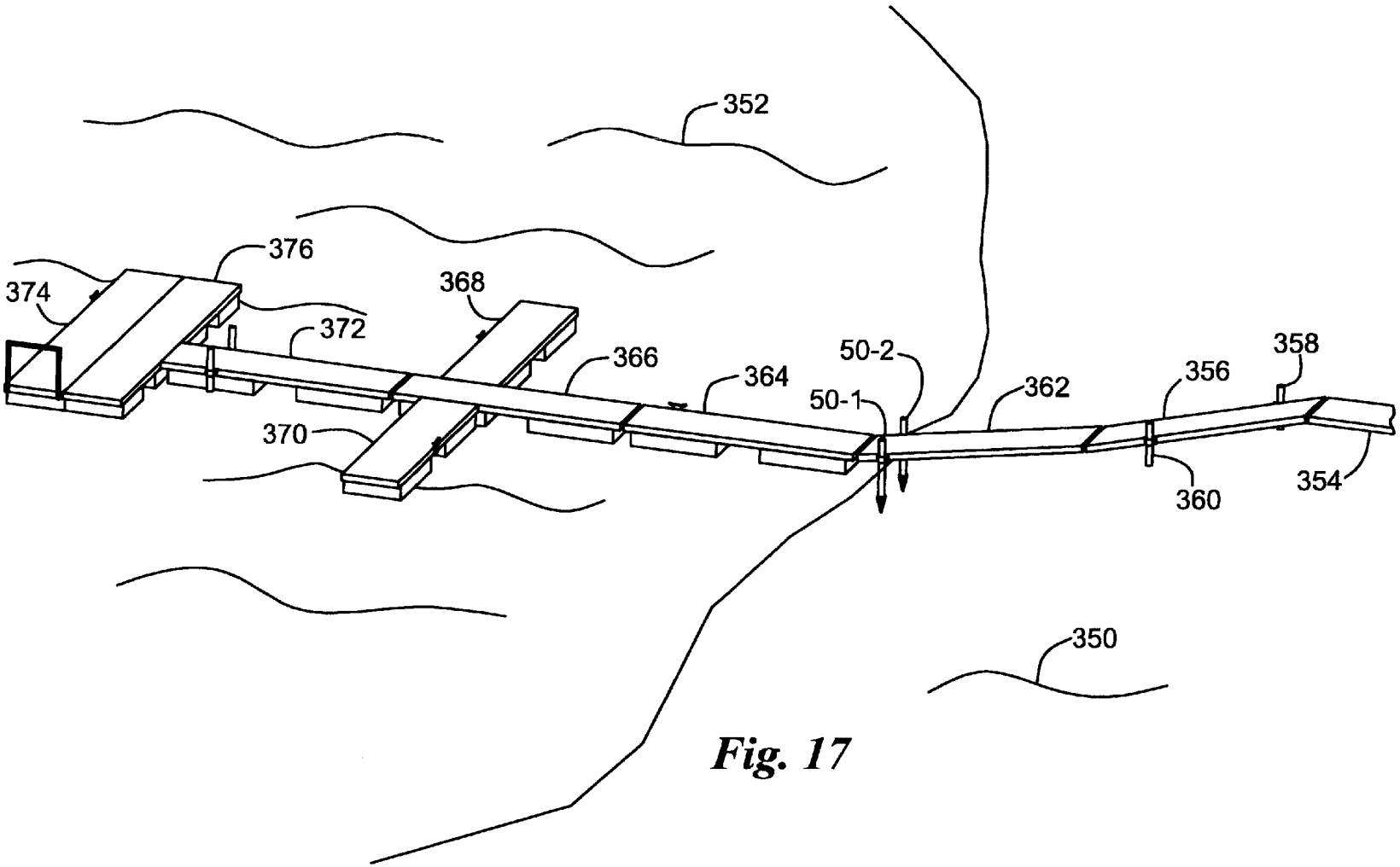
FIG. 17 is a pictorial view of an improved dock structure comprised of a plurality of dock sections illustrating the flexibility of configuration of the components of the improved dock structure.

FIG. 17 is a pictorial for an improved dock structure comprised of a plurality of dock sections illustrating the flexibility of configuration of the components of the improved dock structure. A dock structure is shown to extend from a landmass 350 over a portion of water 352. As illustrated, a first dock section 354 is positioned on the ground 350 and is coupled to dock section 356 in a manner as described above. Dock section 356 is shown supported by leg members 358 and 360 which are supported on the ground surface 350. Dock section 362 is coupled at one end to dock section 356 and is supported at its other end by leg members 50-1 and 50-2, comprising support structures that are augered into the surface ground 350 to provide a relatively fixed support of dock section 362. Dock section 364 is of the floating variety and is coupled at one end to dock section 362 and its other end to dock section 366. Floating dock sections 368 and 370 are coupled at their respective ends to opposite sides of dock section 366. Dock section 366 at its further end is coupled to dock section 372. Floating dock sections 374 and 376 are coupled along their mating side members, and dock section 372 is coupled at its opposite end to the side member of dock 376. It can of course be seen that the modular structure allows virtually any desired dock configuration to be assembled from the modular dock sections. Further, various fixtures can be utilized with any of the dock sections in a manner described above.

Though the entire description has been rendered with regard to a modular dock system connected to a landmass or other fixed support, the modular sections can also be utilized to construct a float structure utilizing one or more sections coupled together as described. Anchor devices can be affixed to one or more of the clete structures, or can be hooked to retention structure (not shown) affixed to one or more of the lower retention channels.

The invention has been fully described in conjunction with Drawings in its preferred embodiment, and has been described in its presently contemplated best mode. It is clear that the invention is susceptible to various modifications, modes of operation and embodiments, all within the ability and skill of those skilled in the art, without further invention. Accordingly, what is intended to be protected by Letters Patent is set forth in the appended Claims.

What I claim is:

1. An improved dock structure comprising:

a pair of side members having associated first and second deck support structures, each of said side members having a first predetermined length and at least one of said pair of side members having at least a first retention channel extending along at least a portion of said predetermined length;

a pair of spaced-apart end members having associated third and fourth deck support structures and coupled intermediate said pair of side members, each of said end members having a second predetermined length, at least one of said pair of spaced-apart end members having at least a second retention channel extending along at least a portion of said second predetermined length;

at least one coupling device having one or more mounting structures having associated mounting portions slidably retained in said first retention channel or said second retention channel, whereby when a fixture is associated with said at least one coupling device, it is capable of being positioned at a desired position along said first retention channel or said second retention channel.

2. An improved dock structure as in claim 1 and further including a fixture associated with said at least one coupling device.

3. An improved dock structure as in claim 2, wherein said fixture comprises:

a coupling hinge structure for removably affixing the dock structure to a related structure.

4. A dock structure as in claim 3, wherein said coupling hinge structure includes first and second cooperating members and a removable pin for joining said first and second cooperating members to form a movable joinder.

5. A dock structure as in claim 4, and further including a first plurality of first cooperating members and a second plurality of second cooperating members.

6. An improved dock structure as in claim 4, wherein said removable pin has an outer surface, a predetermined length, and a substantially circular cross-section, and further includes a coating material having a predetermined thickness on at least a portion of said outer surface, said removable pin being capable of being removed to allow separation of said first and second cooperating member.

7. An improved dock structure as in claim 2, wherein said fixture comprises:

a cleat for tying watercrafts to the dock structure.

8. An improved dock structure as in claim 2, wherein said fixture comprises:

a support leg mechanism including a mounting bracket and a leg structure slidably retained in said mounting bracket, said leg structure having a support end to engage a support surface for holding the dock structure at a predetermined height above the support surface.

9. An improved dock structure as in claim 8, wherein said leg mechanism includes an auger affixed to said support end, and wherein said support leg is rotatable with respect to said mounting bracket, whereby said auger can be rotated to screw into the support surface to thereby cause the dock structure to be held in place.

10. An improved dock structure as in claim 8, wherein said leg mechanism includes a wheel rotatably coupled to said support end.

11. An improved dock structure as in claim 1, wherein at least one member of said pair of side members and said pair of spaced-apart end members includes a third retention channel extending along at least a portion of said first predetermined length or second predetermined length of said at least one member; and further including a float device; and at least a second coupling device including one or more mounting structures having associated mounting portions slidably retained in said third retention channel on said at least one member for removably mounting said float device.

12. An improved dock structure as in claim 1, and further including:

a plurality of spaced-apart deck support members arranged between said pair of spaced apart end members, each of said plurality of deck support members having a first end coupled to a first one said pair of side members, and second end coupled to a second one of said pair of side members and each of said plurality of spaced-apart deck support members having a deck support surface.

13. An improved dock structure as in claim 12, and further including:

one or more deck members removably affixed to associated ones of said deck support surfaces.

14. An improved dock structure as in claim 1, wherein said at least one of said pair of side members further includes a first related retention channel extending along said at least a portion of said first predetermined lengths;

said at least one of said pair of spaced-apart end members further includes a second related retention channel extending along said at least of said second predetermined length; and said coupling device further includes second mounting structure having associated mounting portion slidably retained in said first related retention channel or said second related retention channel.

15. An improved dock structure as in claim 1, wherein said pair of side members and said pair of spaced-apart end members are each integrally formed of lightweight non-corroding material.

16. For use and constructing an improved dock structure, an improved structural member comprising:

a support member having first and second ends, a predetermined length, a face surface, a rear surface opposite said face surface, an upper deck support surface, and a lower structure;

at least one retention channel at said face surface and extending along at least a portion of said predetermined length, and arranged to captively cooperate to slidably retain associated mounting structures on one or more fixtures to allow any such fixture to be positioned as desired along said at least one retention channel; and an additional retention channel extending along at least a portion of said predetermined length, and arranged to captively cooperate to retain one or more mounting structures removably affixed to a downwardly extending fixture.

17. An improved structural member as in claim 16, and further including a deck-edge protective member coupled to said upper deck support surface and extending along at least a portion of said predetermined length.

18. An improved structural member as in claim 16, wherein said support member includes a pair of parallely-disposed spaced-apart retention channels at said face surface.

19. An improved structural member as in claim 16, and further including:

a beam member affixed to said rear surface along at least a portion of said predetermined length.

20. For use and constructing an improved dock structure, an improved structural member comprising:

a support member having first and second ends, a predetermined length, a face surface, a rear surface opposite said face surface, an upper deck support surface, and a lower structure;

at least one retention channel at said face surface and extending along at least a portion of said predetermined length, and arranged to captively cooperate to slidably retain associated mounting structures on one or more fixtures to allow any such fixture to be positioned as desired along said at least one retention channel;

a fixture to be affixed to said support member;

one or more mounting structures coupled to said fixture, and arranged to cooperate with said at least one retention channel to removably and slidably position said fixture on said support member and affix it thereto.

21. An improved structural member as in claim 20, wherein each said mounting structure includes a bolt extending through an associated hole in said fixture;

a captive nut and captive collar positioned in an associated one of said retention channels, said captive nut engaged by said bolt to hold said captive collar in place to hold said fixture tightly to said face surface when tightened and to allow said fixture to be slidably positioned along said support member when said bolt and said captive nut are loosened.

22. An improved structural member as in claim 20, wherein said fixture includes a bracket having a cylindrical coupling portion.

23. A modular structure comprising:

two or more modular sections, each of said sections including a pair of side members having first and second deck support surfaces, each of said side members having a face surface, a first predetermined length and at least one of said pair of side members having at least a first retention channel extending along at least a portion of said first predetermined length, a pair of end members having third and fourth deck support surfaces and coupled intermediate said pair of side members, each of said pair of end members having a face surface, a second predetermined length, and at least one of said pair of end members having at least a second retention channel extending along at least a portion of said second predetermined length;

at least one coupling hinge structure having at least a first mounting structure slidably retained by said at least a first retention channel or by said at least a second retention channel on one of said two or more modular sections;

at least a second coupling hinge structure having at least a second mounting structure slidably retained by said at least a first retention channel or by said at least a second retention channel on a second one of said two or more modular sections; and a pin structure coupling said at least one coupling hinge structure and said at least a second coupling hinge structure, thereby coupling said first one and second one of said two or more modular sections together.

24. A modular structure as in claim 23, wherein each of said at least first mounting structure and said at least second mounting structure includes a separate bolt structure extending through associated holes in an associated one of said at least one coupling hinge structure and said at least a second coupling hinge structure;

a nut and associated collar positioned in each associated ones of said retention channels, each said nut engaged by said separate bolt structure and said associated collar to hold an associated one of said coupling hinge structures tightly to an associated one of said face surfaces when tightened and to allow said associated one of said coupling hinge structures to be slidably adjusted when said separate bolt and nut are loosened.

25. A modular structure as in claim 24, wherein each said at least one coupling hinge structure and each said at least a second coupling hinge structure includes a bracket having a cylindrical coupling portion.

26. A modular structure as in claim 25, wherein said pin structure has a diameter approximating the dimension of each said cylindrical coupling portion and extends therethrough.

27. A modular structure as in claim 26, wherein said pin structure includes an elongated metal rod having a substantially circular cross-section and an outer surface; and a coating of synthetic material having a predetermined thickness adhered to said outer surface.

28. A modular structure as in claim 24, wherein, said at least one of said pair of side members further include a first related retention channel having a first predetermined relationship to said at least a first retention channel, and said least one of said pair of end members further includes a second related retention channel having a second predetermined relationship to said at least a second retention channel.

29. A modular structure as in claim 28, wherein each of said one or more selected fixtures can be selected from the class of fixtures comprising:

a first support leg structure having a lower support end and vertically adjustable to establish a predetermined height;

a second support leg structure having a lower end coupled to an auger device, said second support leg structure being vertically adjustable and rotatable to activate said auger device;

a third support leg structure having a lower end rotatably coupled to a wheel, said third support leg structure being vertically adjustable;

a clete structure;

a railing structure;

a float structure;

a bumper structure having a support portion and a synthetic bumper portion being removably affixed to said support portion, and said support portion being vertically adjustable.

30. A modular structure as in claim 24 and further including one or more selected fixtures, each of said one or more selected fixtures including an associated mounting structures for use in cooperation with an associated one of the various ones of said retention channels.

31. A modular structure as in claim 23 and further including at least one coupling device, each said coupling device including one or more mounting structures in cooperation with one or more of said at least a first retention channel or of said at least a second retention channel; and a related fixture mounted to an associated one or said members by an associated one of said at least one coupling device.

32. A modular structure as in claim 23 wherein at least one member of said pair of side members or at least one member of said pair of end members includes a third retention channel extending along at least a portion of said first predetermined length or said second predetermined length, and further including a float device; and at least a third mounting structure slidably retained in said third retention channel and coupled to said float device.

* * * * *